US007088208B2

(12) United States Patent
Kurasawa et al.

(10) Patent No.: US 7,088,208 B2
(45) Date of Patent: Aug. 8, 2006

(54) WIRE CONNECTING STRUCTURE OF ELECTROMAGNETIC SWITCH OF STARTER

(75) Inventors: Tadahiro Kurasawa, Chita-gun (JP); Tsutomu Shiga, Nukata-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 135 days.

(21) Appl. No.: 10/756,342

(22) Filed: Jan. 14, 2004

(65) Prior Publication Data

US 2004/0159534 A1 Aug. 19, 2004

(30) Foreign Application Priority Data

Jan. 17, 2003 (JP) ..... 2003-009380

(51) Int. Cl.
*H01F 7/08* (2006.01)

(52) U.S. Cl. ..... 335/255; 335/126; 335/131

(58) Field of Classification Search ..... 335/255–256, 335/126, 131
See application file for complete search history.

(56) References Cited

U.S. PATENT DOCUMENTS

| | | | |
|---|---|---|---|
| 3,571,770 | A | 3/1971 | Dew |
| 5,332,926 | A | 7/1994 | Ueno et al. |
| 5,508,566 | A | 4/1996 | Nagao et al. |
| 5,907,204 | A | 5/1999 | Matsushima et al. |

FOREIGN PATENT DOCUMENTS

| | | |
|---|---|---|
| EP | 0800193 | 10/1997 |
| FR | 2819094 | 7/2002 |

*Primary Examiner*—Elvin Enad
*Assistant Examiner*—Bernard Rojas
(74) *Attorney, Agent, or Firm*—Oliff & Berridge, PLC

(57) ABSTRACT

In a starter, an electromagnetic switch is mounted to a seating. A lead wire of an exciting coil is led to an outside of a switch case by a coil-leading portion and is connected to a male terminal, which is fixed to the coil-leading portion by welding. The coil-leading portion is integrally provided with an end plate portion of a bobbin around which the exciting coil is wound. The coil-leading portion passes through and projects from a bottom surface of the switch case to the outside. A metal member, in a form of a plate, is insert-molded in the seating. A 50 terminal is provided on an end of the metal member and a female terminal is provided on an opposite end of the metal member. When the electromagnetic switch is mounted to a predetermined position of the seating, the female terminal engages with the male terminal.

17 Claims, 4 Drawing Sheets

WIRE CONNECTING STRUCTURE OF ELECTROMAGNETIC SWITCH OF STARTER

CROSS-REFERENCE TO RELATED APPLICATION

This application is based on Japanese Patent Application No. 2003-9380 filed on Jan. 17, 2003, the disclosure of which is incorporated herein by reference.

FIELD OF THE INVENTION

The present invention relates to a starter for starting an engine. More particularly, the present invention relates to a wire connecting structure of an electromagnetic switch of the starter.

BACKGROUND OF THE INVENTION

In a starter for starting an engine, an electromagnetic switch is arranged adjacent to an end of a starter motor on a side opposite to a pinion with respect to an axial direction. An exciting coil is provided in the electromagnetic switch. A first lead wire of the exciting coil is connected to a conductive terminal, which is generally known as a 50 terminal, and a second lead wire of the exciting coil is grounded to a holder plate.

An end of the conductive terminal is supported by a seating of the electromagnetic switch. The conductive terminal passes through an end cover that surrounds the periphery of the electromagnetic switch and extends to the outside, so that an opposite end of the conductive terminal connects to a lead wire that connects to a starting switch (ignition switch). This kind of starter is for example disclosed in JP-A-9-79122 (U.S. Pat. No. 5,508,566) and JP-A-9-273465 (U.S. Pat. No. 5,907,204).

In the starter, however, the conductive terminal is supported by the seating of the electromagnetic switch and is distant from a coil-leading portion that leads the lead wire of the exciting coil. Therefore, the lead wire is wired through space from the coil-leading portion to the conductive terminal and connected to the conductive terminal such as by soldering. In this case, the lead wire is unstably wired in the space. Therefore, it is difficult to automate the connection of the lead wire and the conductive terminal.

Further, if the lead wire, which is wired through space, oscillates by being affected by vibrations, it is likely to brake and interfere with other parts. To solve this problem, for example, a part of the lead wire can be clamped. However, this results in an increase in the number of working steps and further results in an increase in manufacturing costs.

SUMMARY OF THE INVENTION

The present invention is made in view of the above matters, and it is an object of the present invention to provide a starter with an enhanced wire connection from an exciting coil to a conductive terminal.

It is another object of the present invention to provide a wire connection of an electromagnetic switch of the starter having an improved vibration resistance.

According to a first aspect of the present invention, a starter has a seating disposed adjacent to an axial end of a starter motor, an electromagnetic switch mounted on the seating, a conductive terminal for supplying current to an exciting coil of the electromagnetic switch. The electromagnetic switch has a switch case housing the exciting coil therein, a coil-leading portion that leads a lead wire of the exciting coil to an outside of the switch case, and a first terminal portion fixed to the coil-leading portion. The lead wire led by the coil-leading portion is connected to the first terminal portion. A metal member is disposed on the seating and the conductive terminal is provided on a first end of the metal member. A second end of the metal member includes a second terminal portion that engages with the first terminal portion.

Accordingly, the first terminal portion is provided separately from the conductive terminal. The first terminal portion electrically connects to the conductive terminal by engaging with the second terminal portion provided on the second end of the metal member. Therefore, the lead wire, which is fixed to the first terminal portion, is electrically connected to the conductive terminal. Accordingly, even if the conductive terminal is distant from the coil-leading portion, the lead wire is stably wired. Therefore, the vibration resistance of the lead wire is improved.

According to a second aspect of the present invention, a starter includes an electromagnetic switch having an exciting coil and a conductive terminal for supplying current to the exciting coil. The electromagnetic switch further includes a switch case housing the exciting coil therein, a coil-leading portion that leads a lead wire of the exciting coil to an outside of the switch case. The conductive terminal is fixed to the coil-leading portion and the lead wire, which is led by the coil-leading portion is connected to the conductive terminal.

Accordingly, since the conductive terminal is fixed to the coil-leading portion and the lead wire is directly connected to the conductive terminal, the lead wire is not wired through a space in an unstable manner. Since the lead wire is stably connected, the resistance due to vibration is improved. Further, the wire connecting structure is simplified.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Embodiments of the present invention will be described hereinafter with reference to the drawings.

First Embodiment

Figure 1:
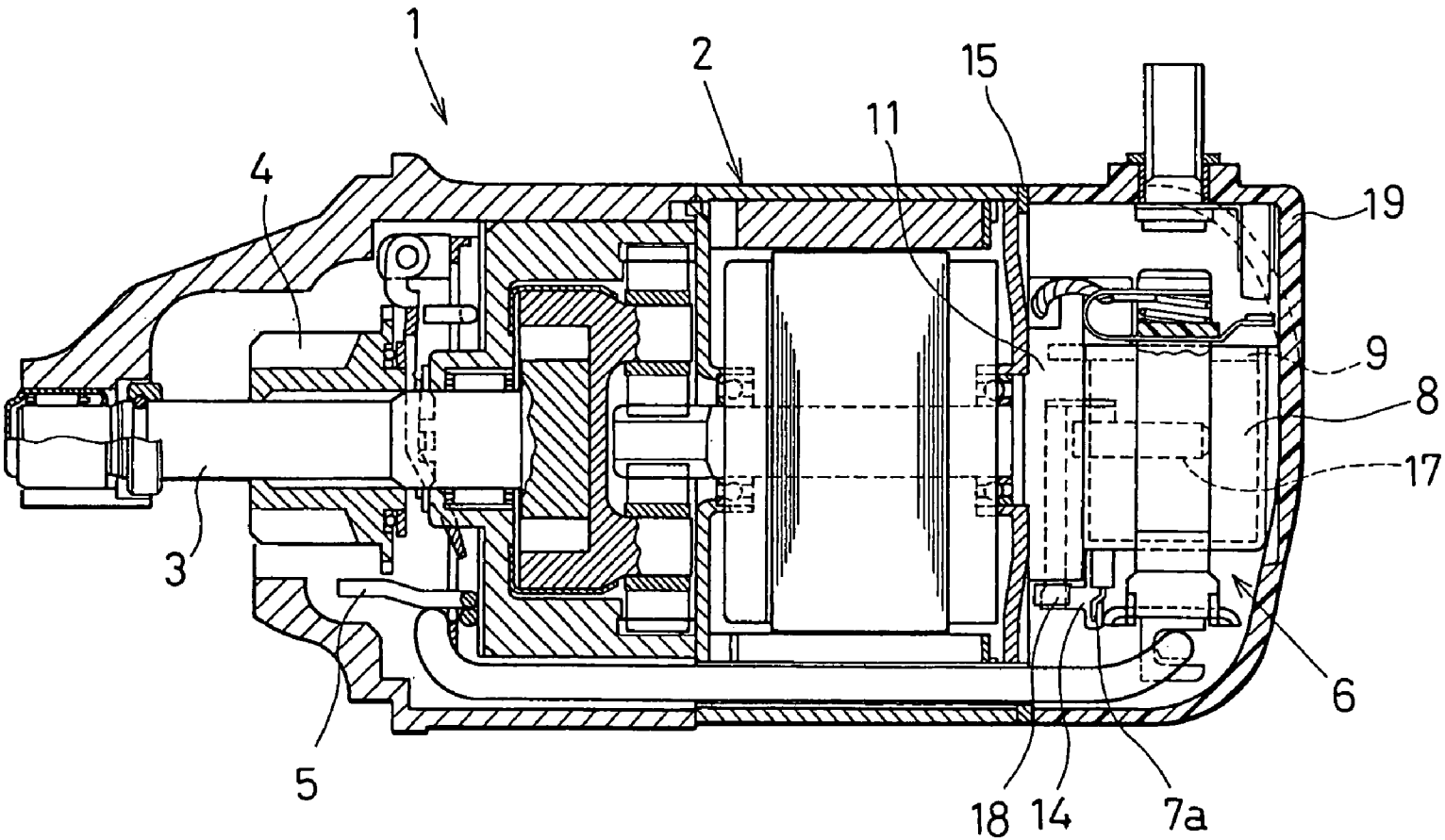
FIG. 1 is a general cross-sectional view of a starter according to a first embodiment of the present invention.

Referring to FIG. 1, a starter 1 of the embodiment is constructed of a motor 2, an output shaft 3, a pinion 4, a pinion restricting member 5, an electromagnetic switch 6, and the like. The motor 2 generates a rotation force, and the output shaft 3 is driven by the rotation of the motor 2. The pinion 4 is engaged on the output shaft 3 through helical splines. The pinion restricting member 5 restricts rotation of the pinion 4 on starting the motor 2. The electromagnetic switch 6 controls ON/OFF of current supply to the motor 2. For starting an engine, the pinion 4, which is supported in a rotation restricted manner, is moved in axially forward direction (to the left side in FIG. 1) and meshed with a ring gear (not shown) of an engine. The detailed structure and operation of the starter 1 other than the electromagnetic switch 6 are similar to a starter of JP-A-9-79122.

Hereafter, the detailed structure and the fixing structure of the electromagnetic switch 6 will be described with reference to FIGS. 1 through 4B.

The electromagnetic switch 6 includes an exciting coil 7, a switch case 8, a fixed core 9, a plunger 10 and the like. The exciting coil 7 is wound around a bobbin and housed in the switch case 8, as shown in FIG. 3A. The fixed core 9 produces a magnetic path of the exciting coil 7 with the switch case 8. The plunger 10 is inserted in an inner periphery of the exciting coil 7, as shown in FIG. 2.

As shown in FIG. 1, the electromagnetic switch 6 is mounted to a resinous seating 11 in a rear portion of the starter 1. That is, the electromagnetic switch 6 is located adjacent to an axial end of the motor 2 on a side opposite to the pinion 4 with respect to an axial direction. Further, the electromagnetic switch 6 is arranged such that a moving direction of the plunger 10 (up and down direction in FIG. 2) is perpendicular to the axial direction of the motor 2 (left and right direction in FIG. 1).

Figure 2:
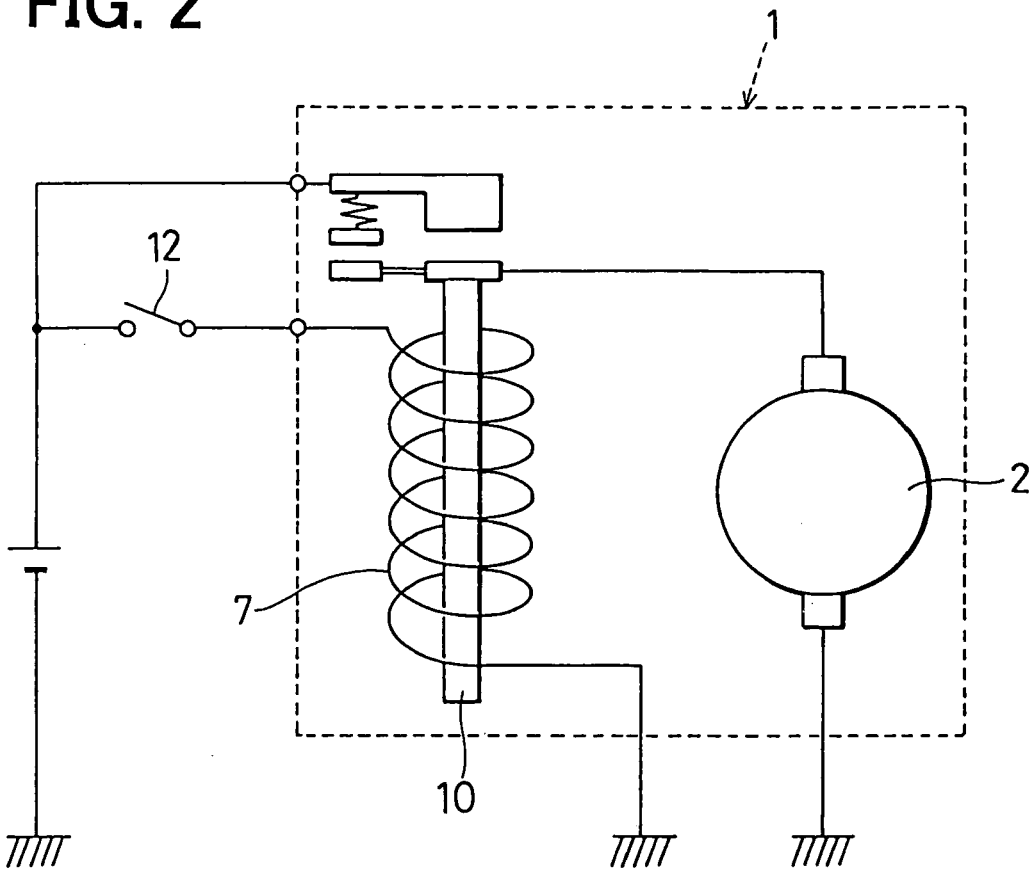
FIG. 2 is a circuit diagram of the starter according to the first embodiment of the present invention.
Figure 3A:
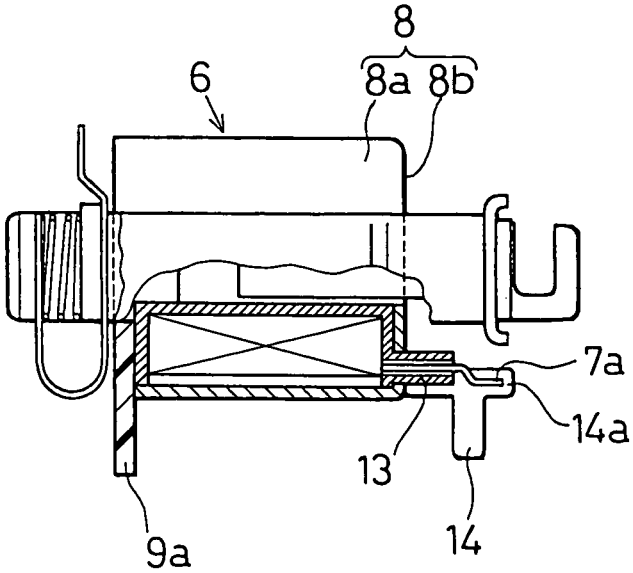
FIG. 3A is a side view of an electromagnetic switch of the starter, partly including a cross-section, according to the first embodiment of the present invention.
Figure 3B:
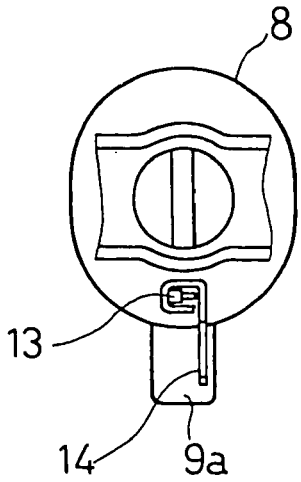
FIG. 3B is an axial end view of the electromagnetic switch according to the first embodiment of the present invention.

As shown in FIG. 2, when an ignition key 12 is turned on, the exciting coil 7 is energized, thereby producing magnetic force. As shown in FIGS. 3A and 3B, a lead wire 7*a*, which is one of lead wires of the exciting coil 7, is led by a coil-leading portion 13 and extends to an outside of the switch case 8. Outside the switch case 8, the lead wire 7*a* is connected to a male terminal (first terminal portion) 14 such as by welding. An opposite lead wire (not shown) is grounded to a metal plate 15 that holds the seating 11, as shown in FIG. 1.

The coil-leading portion 13 is integrally formed with an end plate portion of the bobbin, the end plate being arranged on one end of the exciting coil 7. As shown in FIG. 3A, the coil-leading portion 13 passes through a bottom surface 8*b* of the switch case 8 in an axially outward direction.

As shown in FIG. 3B, the male terminal 14 is fixed such that it wraps an outer periphery of the coil-leading portion 13 projecting from the switch case 8. Specifically, the male terminal 14 is press-fitted to the coil-leading portion 13. Further, the male terminal 14 extends toward the seating 11 (lower side in FIG. 3). The male terminal 14 has a connecting portion 14*a* to which the lead wire of the exciting coil 7 is connected. The connecting portion 14*a* is in a form of plate and is disposed to extend along the direction that the coil-leading portion 13 projects. The lead wire 7*a* is connected throughout the connecting portion 14*a*, as shown in FIG. 3A.

The switch case 8 has a cylindrical wall portion 8*a* that surrounds an outer periphery of the exciting coil 7 and the bottom surface 8*b* that covers the end plate portion of the bobbin. The bottom surface 8*b* is formed with a circular hole (not shown) in its middle portion, through which the plunger 10 passes.

The fixed core 9 is arranged at a position adjacent to an opening of the switch case 8, that is, on a side opposite to the bottom surface 8*b*. The fixed core 9 covers the opening of the switch case 8. The fixed core 9 is provided with a positioning projection 9*a* for positioning the electromagnetic switch 6 with respect to the seating 11 while mounting the electromagnetic switch 6 to the seating 11. The positioning projection 9*a* extends through and to the outside of the switch case 8 and projects in the direction parallel to the male terminal 14, as shown in FIG. 3A.

The plunger 10 is opposed to the fixed core 9 with air gaps between them. The plunger 10 is biased in a direction opposite to the fixed core 9 by a return spring (not shown) provided between the plunger 10 and the fixed core 9.

Figure 4A:
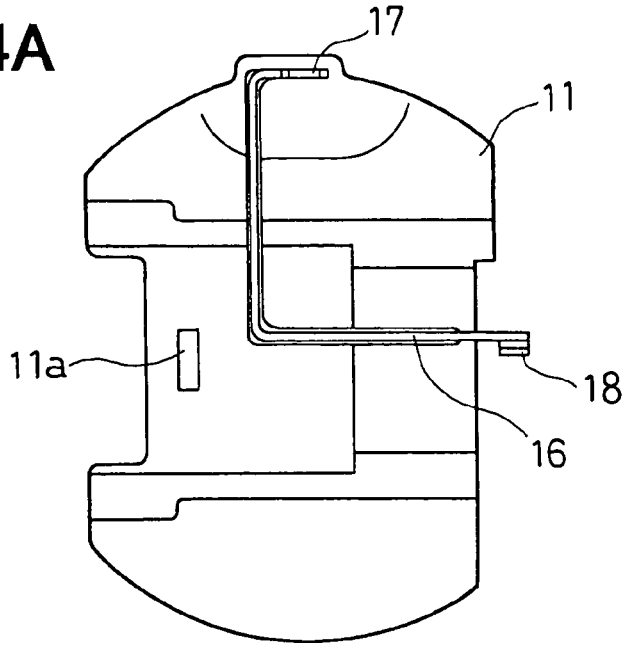
FIG. 4A is a plan view of a seating of the starter according to the first embodiment of the present invention.
Figure 4B:
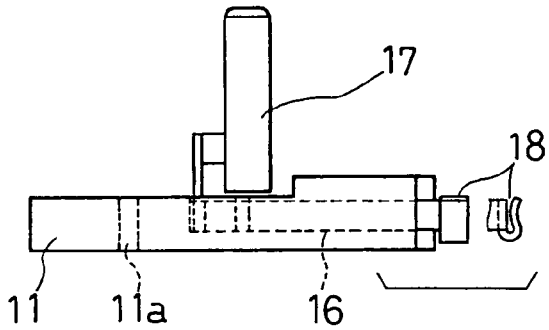
FIG. 4B is a side view of the seating according to the first embodiment of the present invention.

As shown in FIGS. 4A and 4B, a metal member 16, which is in a form of plate, is provided in the seating 11 by insert-molding. The metal member 16 is provided with a conductive terminal 17 for supplying current to the exciting coil 7 on an end and a female terminal (second terminal portion) 18 on an opposite end. Hereafter, the conductive terminal 17 is referred to as a 50 terminal 17.

As shown in FIG. 4B, the 50 terminal 17 projects (upward in FIG. 4B) from the seating 11. The 50 terminal 17 further extends through an end frame 19, which surrounds the outer periphery of the electromagnetic switch 6, to the outside of the frame 19. The 50 terminal 17 is connected to the ignition key 12 through an electric wire, as shown in FIG. 2. When the electromagnetic switch 6 is fixed to a predetermined position of the seating 11, the male terminal 14 engages with the female terminal 18 so that the 50 terminal 17 electrically connects to the exciting coil 7.

On the seating 11, a positioning hole 11*a* corresponding to the positioning projection 9*a* of the electromagnetic switch 6 is formed. The positioning projection 9*a* and the positioning holes 11*a* are provided such that a fixing position of the electromagnetic switch 6 with respect to the seating 11 is restricted before the male terminal 14 engages with the female terminal 18, while mounting the electromagnetic switch 6 to the seating 11. That is, the positioning projection 9*a* and the positioning hole 11*a* are arranged such that the positioning projection 9*a* can enter the positioning hole 11*a* before the male terminal 14 fits in the female terminal 18.

In the starter 1 of the embodiment, the male terminal 14 is fixed to the coil-leading portion 13 and the lead wire 7*a* of the exciting coil 7 is connected to the male terminal 14. Further, in a condition that the electromagnetic switch 6 is mounted to the seating 11, the male terminal 14 engages with the female terminal 18, so the lead wire 7*a* is electrically connected to the 50 terminal 17. Therefore, even when the 50 terminal 17 is distant from the coil-leading portion 13, the lead wire 7*a* is not wired from the coil-leading portion 13 to the 50 terminal 17 through space. Because the lead wire 7*a* is connected to the male terminal 14 in a stable manner, it is possible to automate the connection of the lead wire 7*a*. Accordingly, assembling efficiency of the starter 1 is improved.

Further, the lead wire 7*a* is directly connected to the male terminal 14 without wiring through space. Therefore, it is less likely that the lead wire 7*a* will be oscillated due to vibrations of a vehicle. Accordingly, it is not necessary to fix the lead wire 7*a* partly by using such as clamps. The lead wire 7*a* is restricted from breaking or interfering with other parts.

In addition, the male terminal 14 is fixed in a condition wrapped around the coil-leading portion 13. That is, the male terminal 14 is press-fitted to the coil-leading portion 13. Therefore, a fixing strength of the male terminal 14 to the coil-leading portion 13 is increased greater than an engaging force that is a force required to engage the male terminal 14 with the female terminal 18. That is, the male terminal 14 is secured to the coil-leading portion 13. As a result, it is not necessary to hold the male terminal 14 while engaging the male terminal 14 to the female terminal 18. Accordingly, efficiency of mounting the electromagnetic switch 6 to the seating 11 is improved.

Also, a part of the metal member 16 between the 50 terminal 17 and the female terminal 18 is embedded in the seating 11 by insert-molding. The seating 11 is made of a resin material having insulation. Since the metal member 16 is not exposed to the outside of the seating 11, it is not necessary to process the metal piece to have insulation. Further, since the metal member 16 is securely held in the seating 11 by insert-molding, the metal member 16 does not oscillate solely even when it is affected by vibrations. Therefore, it is less likely that the male terminal 14 will be disengaged from the female terminal 18 by the vibrations.

In the example shown in FIG. 4A, the upper side of the metal member 16 is open. Alternatively, the part of the metal member 16 between the 50 terminal 17 and the female terminal 18 can be fully covered or fully embedded in the seating 11.

The electromagnetic switch 6 and the seating 11 respectively have the positioning projection 9*a* and the positioning hole 11*a* as positioning means. While the electromagnetic switch 6 is mounted to the seating 11, the positioning projection 9*a* enters in the positioning hole 11*a* before the male terminal 14 fits in the female terminal 18. Therefore, the mounting position of the electromagnetic switch 6 with respect to the seating 11 can be restricted.

In this construction, the male terminal 14 engages with the female terminal 18 in the condition that the position of the electromagnetic switch 6 to the seating 11 is restricted. Therefore, it is less likely that the electromagnetic switch 6 will be largely displaced with respect to the seating 11 after the engagement of the male terminal 14 and the female terminal 18. Accordingly, while mounting the electromagnetic switch 6 to the seating 11, the male terminal 14 and the female terminal 18 do not receive large external force. Therefore, the terminals 14, 18 are less likely to be deformed. As a result, engagement defect or contact defect due to deformation of the terminals 14, 18 is decreased.

Since the female terminal 18 is arranged at the position corresponding to the male terminal 14, the male terminal 14 and the female terminal 18 are engaged with each other at the same time mounting the electromagnetic switch 6 to the seating 11.

The coil-leading portion 13 is integrally formed into the bobbin on which the exciting coil is wound. By this, even if the electromagnetic switch 6 is affected by vibrations, it is less likely that the male terminal 14, the bobbin, and the exciting coil 7 will be relatively displaced from each other. As a result, a break of the lead wire 7*a* is reduced.

The terminal 14, 18 have the engaging structure that one of which is fitted to the other. Therefore, at the same time fixing the electromagnetic switch 6 to the seating 11, the terminals 14, 18 are easily and securely connected. The terminal 14 fixed to the coil-leading portion 13 can be a female terminal and the terminal 18 of the metal fitting 16 can be a male terminal, alternatively.

Second Embodiment

In the second embodiment, the engaging portion of the male terminal 14 and the female terminal 18 is arranged in a closed space.

Figure 5A:
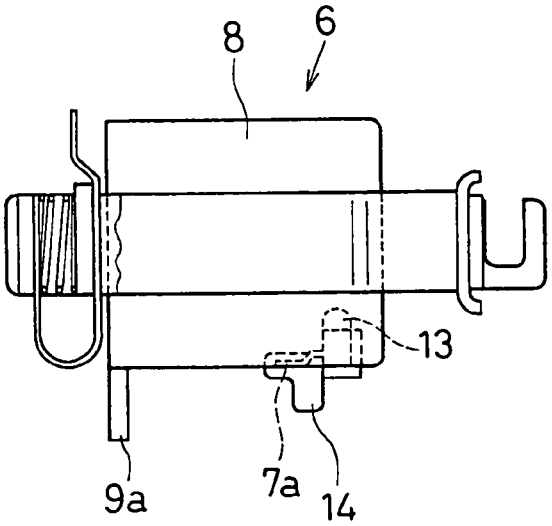
FIG. 5A is a side view of an electromagnetic switch of the starter according to a second embodiment of the present invention.
Figure 5B:
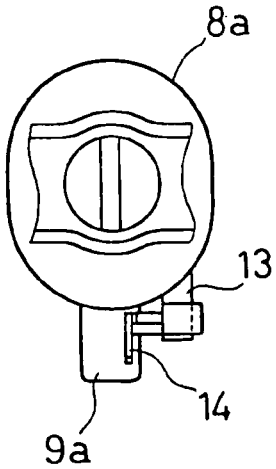
FIG. 5B is an axial end view of the electromagnetic switch according to the second embodiment of the present invention.

As shown in FIGS. 5A and 5B, the coil-leading portion 13 is formed to project through the cylindrical wall portion 8*a* of the switch case 8. The male terminal 14 is fixed to the coil-leading portion 13. Similar to the first embodiment, the lead wire 7*a* of the exciting coil 7 is led to the outside of the switch case 8 by the coil-leading portion 13 and is connected to the male terminal 14 such as by welding.

Figure 6:
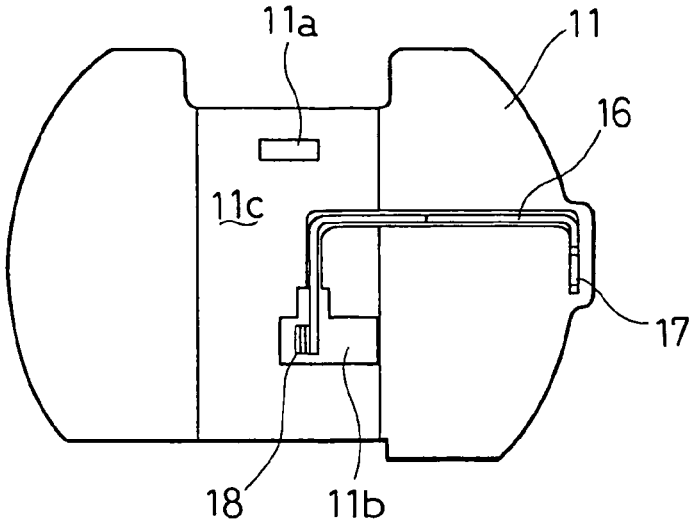
FIG. 6 is a plan view of a seating of the starter according to the second embodiment of the present invention.
Figure 7:
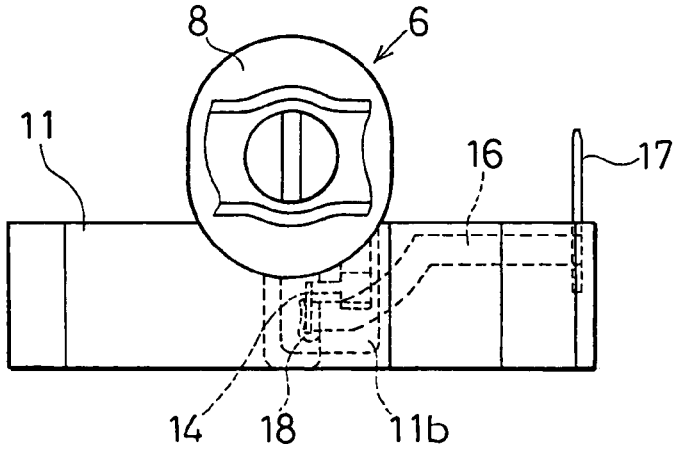
FIG. 7 is a side view of the seating, shown in FIG. 6, on which the electromagnetic switch is mounted.

As shown in FIGS. 6 and 7, the female terminal 18 is arranged in a recess portion 11*b* formed in the seating 11. The recess portion 11*b* is provided by a recess that is recessed from a supporting surface 11*c* of the seating 11 and surrounded with walls of the seating 11. The supporting surface 11*c* supports an outer peripheral surface of the switch case 8.

In the above configuration, when the electromagnetic switch 6 is mounted on the seating 11 as shown in FIG. 7, an opening of the recess portion 11*b* is covered by the outer peripheral surface of the switch case 8. Further, the male terminal 14 engages with the female terminal 18 in the inside of the recess portion 11*b*, which is a closed space.

In the second embodiment, advantages similar to the first embodiment can be provided. In addition, since the engaging portion of the male terminal 14 and the female terminal 18 is insulated from the outside, it is less likely that foreign materials such as sand or dust will enter and adhere onto the terminal engaging portion. Therefore, poor connection is reduced. Accordingly, a highly reliable wire-connecting structure can be provided.

Third Embodiment

Figure 8:
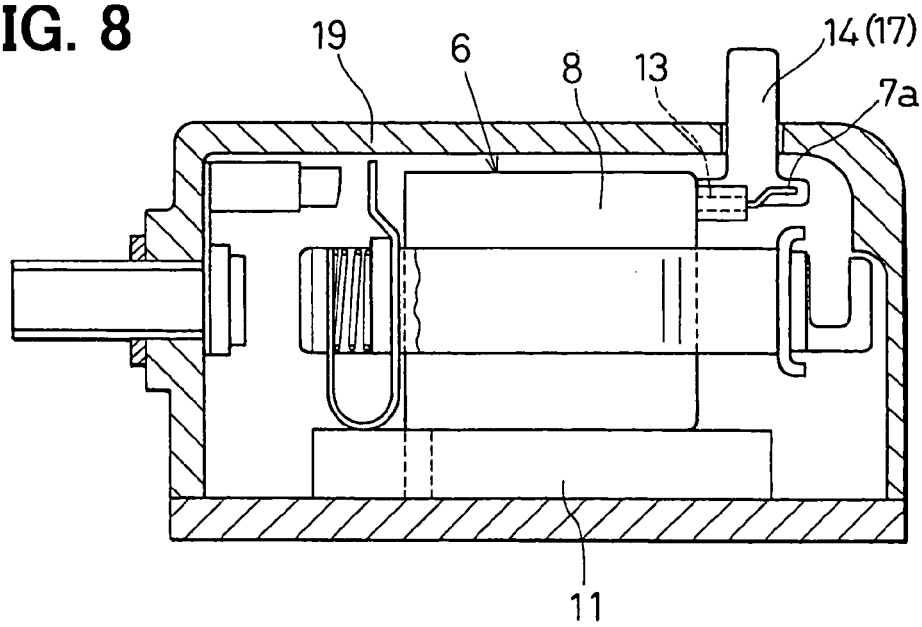
FIG. 8 is a cross-sectional view of an end portion of the starter for showing a connecting structure of the electromagnetic switch according to a third embodiment of the present invention.

In the third embodiment, the male terminal 14 and the 50 terminal 17 are integrated into a single piece, as shown in FIG. 8.

The male terminal 14 is, as shown in FIG. 8, fixed to the coil-leading portion 13 at a position adjacent to the end frame 19. As the 50 terminal 17, an end of the male terminal 14 passes through the end frame 19 and extends to the outside of the end frame 19.

In this construction, since the male terminal 14 functions as the 50 terminal 17, the metal member 16 of the first embodiment and the second embodiment is not necessary. As a result, the configuration of the terminal is simplified, and a resistance against the vibration is improved. In the third embodiment, the lead wire 7*a* is connected to the female terminal 14, which is fixed to the coil-leading portion 13, in a manner similar to that of the first embodiment. Therefore, advantage similar to the first embodiment can be provided.

The present invention should not be limited to the disclosed embodiment, but may be implemented in other ways without departing from the spirit of the invention.

What is claimed is:

1. A starter comprising:

a starter motor;

a seating disposed adjacent to an axial end of the starter motor;

an electromagnetic switch mounted on the seating, the electromagnetic switch having an exciting coil;

a metal member disposed on the seating, the metal member having a first end and a second end; and a conductive terminal provided on the first end of the metal member for supplying current to the exciting coil, wherein the electromagnetic switch further has a switch case housing the exciting coil therein, a coil-leading portion that leads a lead wire of the exciting coil to an outside of the switch case, and a first terminal portion fixed to the coil-leading portion, the lead wire is connected to the first terminal portion, the second end of the metal member defines a second terminal portion, and the metal member is arranged along a surface of the seating such that the second terminal portion is located at a position corresponding to the first terminal portion to engage with the first terminal portion.

2. The starter according to claim 1, wherein the second terminal portion is arranged at a position such that the second terminal portion engages with the first terminal portion when the electromagnetic switch is mounted to a predetermined position of the seating.

3. The starter according to claim 2, wherein the electromagnetic switch has a first positioning means and the seating has a second positioning means, wherein the first positioning means and the second positioning means are disposed such that a mounting position of the electromagnetic switch with respect to the seating is restricted before the first terminal portion engages with the second terminal portion while the electromagnetic switch is mounted to the seating.

4. The starter according to claim 3, wherein the first terminal portion is fixed to the coil-leading portion with predetermined fixing strength that is equal to or greater than a force required to engage the first terminal portion with the second terminal portion.

5. The starter according to claim 4, wherein the coil-leading portion is integrally formed into a bobbin on which the exciting coil is wound, and the coil-leading portion extends to an outside of the switch case.

6. The starter according to claim 1, wherein the seating is made of an insulating material and the metal member is fixed in the seating by insert-molding.

7. The starter according to claim 1, wherein the seating defines a support face that faces an outer peripheral surface of the switch case and a recess portion, the recess portion being recessed from the support face and is covered by a part of the outer peripheral surface of the switch case, and the metal member is disposed on the seating such that the second terminal is located in the recess portion and engages with the first terminal portion therein.

8. The starter according to claim 1, wherein the first terminal portion is in a form of one of a male terminal and a female terminal, and the second terminal portion is in a form of the other one of the male terminal and the female terminal.

9. The starter according to claim 1, wherein the electromagnetic switch has a first positioning means and the seating has a second positioning means, wherein the first positioning means and the second positioning means are disposed such that a mounting position of the electromagnetic switch with respect to the seating is restricted before the first terminal portion engages with the second terminal portion while the electromagnetic switch is mounted to the seating.

10. The starter according to claim 9, wherein the first positioning means is provided by a projection projecting from the electromagnetic switch and the second positioning means is provided by a hole formed on the seating.

11. The starter according to claim 10, wherein the first terminal portion is disposed to project in a direction parallel to the first positioning means.

12. The starter according to claim 1, wherein the first terminal portion is fixed to the coil-leading portion with predetermined fixing strength that is equal to or greater than a force required to engage the first terminal portion with the second terminal portion.

13. The starter according to claim 1, wherein the coil-leading portion is integrally formed into a bobbin on which the exciting coil is wound, and the coil-leading portion passes through a wall of the switch case and extends to an outside of the switch case.

14. The starter according to claim 1, wherein the metal member has a plate shape.

15. The starter according to claim 1, wherein the seating is disposed parallel to an axis of the exciting coil, and a portion of the metal member between the conductive terminal and the second terminal portion is embedded in the seating.

16. The starter according to claim 15, wherein the electromagnetic switch has a first positioning means, the seating has a second positioning means that engages with the first positioning means, and the first positioning means and the first terminal portion extend in a direction perpendicular to the axis of the exciting coil.

17. The starter according to claim 15, wherein the seating is located between the starter motor and the electromagnetic switch.

* * * * *